United States Patent [19]

White

[11] 4,075,614

[45] Feb. 21, 1978

[54] CHRISTMAS TREE FIRE DETECTOR AND ALARM

[76] Inventor: Donald A. White, 4701 E. Kessler View, Indianapolis, Ind. 46220

[21] Appl. No.: 696,483

[22] Filed: June 16, 1976

[51] Int. Cl.[2] ..... G08B 17/06

[52] U.S. Cl. ..... 340/227.1; 315/130; 337/411; 340/220

[58] Field of Search ..... 340/227.1, 220; D10/104, 106; D11/125, 124, 121; 240/10 T, 10 S; 315/178, 130, 134, 136; 337/401, 411, 373

[56] References Cited

U.S. PATENT DOCUMENTS

| | | | |
|---|---|---|---|
| 2,048,630 | 7/1936 | Davis | 340/227.1 |
| 2,982,949 | 5/1961 | Pivetz | 340/227.1 |
| 3,095,556 | 6/1963 | Fuller | 340/227.1 |
| 3,475,744 | 10/1969 | Frankfurt | 340/227.1 |
| 3,522,595 | 8/1970 | White | 340/227.1 |

*Primary Examiner*—Glen R. Swann, III
*Attorney, Agent, or Firm*—Beall & Jeffery

[57] ABSTRACT

A fire detector and alarm is provided with means to mount it on a Christmas tree so as to be activated by the rapid buildup and intense heat of a Christmas tree fire. The power may be derived from a battery or the standard socket of a string of Christmas tree lights or from the electrical circuit with any Christmas tree decoration. The decorative shape of the alarm housing has a plurality of openings consistent with such decorative shape for passing the sound therethrough, and further is provided with a resonance chamber. With closure of a bimetallic switch, the heat of the fire will melt the solder of the switch contacts so that with subsequent cooling, the solder will harden prior to opening of the bimetallic contacts, so that they will remain closed even after cooling.

15 Claims, 5 Drawing Figures

CHRISTMAS TREE FIRE DETECTOR AND ALARM

BACKGROUND OF THE INVENTION

For years, there has been a yearly history of fires starting within both natural and artificial Christmas trees, as well as within other Christmas decorations. These fires have consistently been responsible for heavy property damage and the loss of many lives. Such fires are often started by faulty wiring or by children, however the nature of such fires, due to the presence of dry natural trees, combustion supportive artificial trees and decorations, and paper or other flammable products in the proximity of such trees, has been such as to cause the rapid destruction of the tree with a rapid buildup of intense heat, so as to ignite the flammable surroundings to cause a more wide-spread fire.

While there have been and presently are many devices capable of sensing a fire, they are not suitable to be used directly with a Christmas tree or the like and their general use has met with considerable consumer resistance. A primary consumer objection has been the high cost for a sophisticated alarm system, such as would detect smoke by photoelectric or ionization detection. While there have been many attempts to lower this cost by utilizing heat activated alarm systems, they fail to instill confidence in the consumer since they must be placed in the immediate proximity of the fire to give amply and early warning, and by the nature of such a fire, the consumer is not forwarned of where the fire will break out. An attempt to place a conventional fire detector within the proximity of a tree, so as to respond to the heat of a fire within a Christmas tree, would meet with the objection that it would not be consistent with the spirit and decorative effect of the Christmas tree. Since the Christmas tree is traditional in the United States and many other countries, the attachment of a conventional alarm system within the tree would not be aesthetically desirable or marketable, since the decorating of the tree itself is associated with traditional decorative ornaments and lights.

The nature of a Christmas tree fire is such that there is rapid ignition with a rapid buildup of intense heat, which intense heat will be of short duration and followed by a rapid cooling of the immediate vicinity of the former Christmas tree till such time as any adjacent fire may provide heat.

SUMMARY OF THE INVENTION

Accordingly, it is the object of the present invention to provide a Christmas tree fire detector and alarm that may be attached to a Christmas tree as a decorative Christmas tree ornament without detracting from the aesthetic qualities and spirit of the Christmas tree, which will be sufficiently sensitive to the short duration of a Christmas tree fire while being designed to operate within a fire with a better ability to survive and remain operational, and to remain activated after cooling.

It is the general aim of the present invention to provide a new and improved, compact and economical fire sensing and warning device that is simple and easily installed in any Christmas tree or similar decoration where it may quickly detect a fire originating within the tree or decoration, yet provide a degree of reliability in consumer acceptance not now available from an economical heat detecting apparatus designed to operate for periods within the fire or flames.

The present invention provides an inexpensive and appropriately decorative heat detecting alarm system which will activate the audible alarm system into a permanent "on" mode should flames reach or engulf the alarm at temperatures sufficient to melt an electrically conductive material such as rosin-core solder without interfering with the normal cyclic action of a heat responsive bimetalic switch at temperatures less than that which would melt the solder; at below the melting temperature, the switch may close to activate the alarm and reopen upon cooling.

The housing for the alarm device is unobtrusive within the tree, while being designed as a Christmas tree ornament and utilizing additional space within the housing to serve as a resonance chamber to accentuate the sound of an audible alarm, and further the housing is provided with a plurality of openings consistent with the decorative effect for permitting both heat access to the thermostatic switch within the housing and the release of the audible signal directly through such vents to the exterior of the housing. The housing is fire resistant or retardent to insulate electrical components within.

Power for the device may be obtained from a battery so that it can be provided as an independent decoration, or is provided from the household current through the standard light bulb socket of a string of Christmas tree lights, or is provided by interwiring with circuit powered lights or a Christmas tree decoration or associated device, or obtained from any external power source.

BRIEF DESCRIPTION OF THE DRAWINGS

Further objects, features and advantages of the present invention will become more clear from the following detailed description of the drawings, wherein.

DETAILED DESCRIPTION

Figure 1:
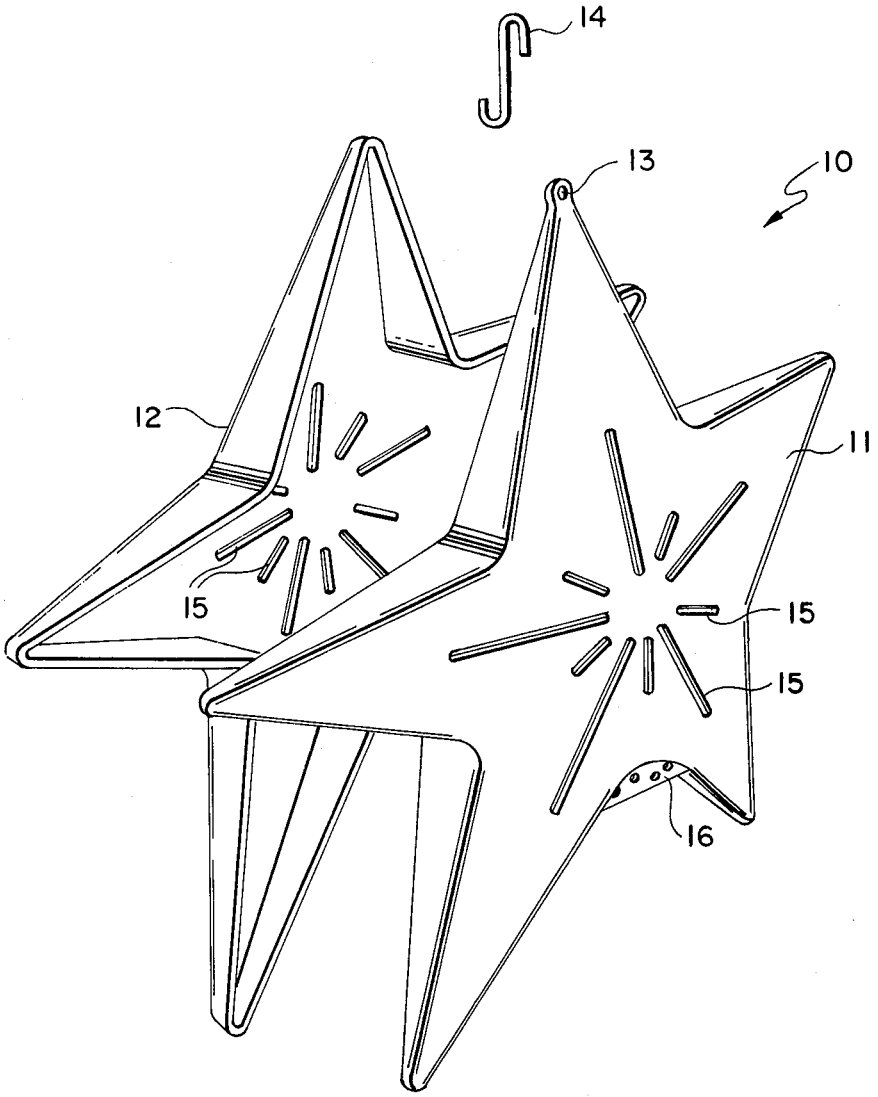
FIG. 1 is a front, exploded, view of one embodiment of the present invention.

In FIG. 1, the Christmas tree fire detector and alarm 10 is provided with a housing consisting of a front housing portion 11 and a rear housing portion 12, which when assembled will form a star shaped exterior and star shaped interior chamber with the interior peripheral edges of the housing portions being bonded together by an adhesive or other suitable means. The housing portions are preferably constructed of stamped sheet metal or a fire resistant plastic. Each of the housing portions is provided with an opening 13 (the opening for the rear housing portion being hidden), which openings 13 are aligned in the assembled housing for the reception of a conventional Christmas tree hanger 14 that has a lower hook for passing through the holes 13 and an upper hook for securement to the limb or the like of a Christmas tree. As a variation, means may be provided on the lower portion of the star, for example, as a downwardly opening cone depending from the rear portion of the rear housing portion 13, for reception over and securement to the uppermost vertically extending trunk portion of a Christmas tree.

Each of the housing portions 11 and 12 is provided with a plurality of through openings 15 that are consistent with the overall decorative design. Specifically, such openings have taken the form of radiating slots. These openings will provide for the transmission of sound generated within the interior of the star shaped housing to the outside environment. The housing portions are constructed of a fire-resistant or fire-retardent material, such as stamped sheet metal or fire resistant plastic. It is contemplated that the shape of the housing 11, 12 may be in the form of a Christmas tree, ball, a Santa Claus, angel, the shape of a real or cartoon character, a decorated square or rectangular shape, or the like so long as it had a pleasing appearance within the tree, but otherwise the details would be similar.

Figure 2:
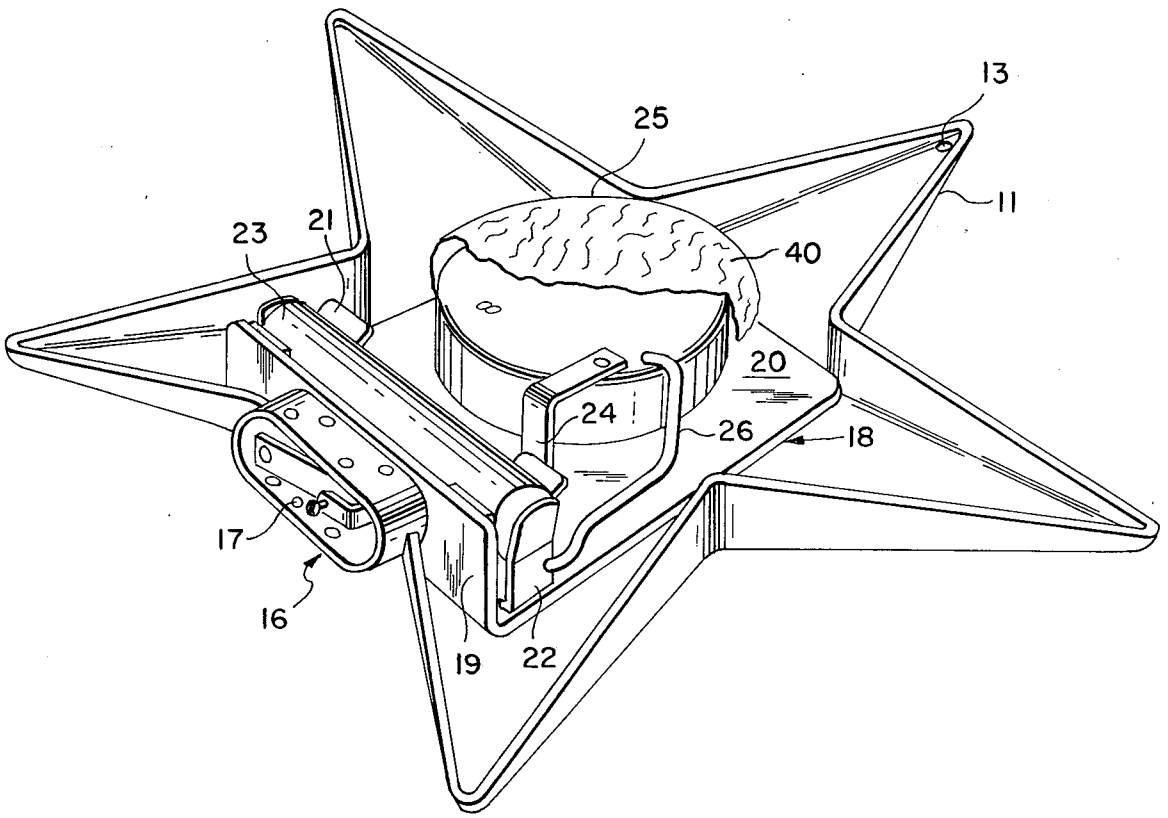
FIG. 2 is a rear perspective view of the front portion of the embodiment shown in FIG. 1.

Depending from the lower portion of the front housing portion 11, there is provided a fire detector 16, as more clearly shown in FIG. 2. The detector includes a tubular housing having a plurality of openings 17 for the free circulation of air through the open bottom of the housing and through the opening 17 of the side walls of the housing, so that smoke and heated air from a Christmas tree fire will freely pass through the interior of the housing of the detector 16. This detector housing has mounted within its interior a thermostatic switch that is described more fully with respect to FIG. 4.

Within the star shaped interior of the housing 11, 12, there is provided a fire resistent component mounting board 18 of L-shape with a leg portion 19 closing and sealing the upper end of the detector housing while permitting the passage of wires from the interior of the housing 11, 12 to the switch within the detector 16. The main leg 20 of the board has mounted thereon a conventional clip support for a battery with a ground end 21 and a positive end 22 to receive the battery 23. The board 18 is constructed of a fire resistant material and additionally provides a heat shield for the interior components of the housing. A bracket 24 mounted at one end (not shown) to the board 18 supports at its other end an audible alarm 25 that is electrically energized by means of an insulated wire 26 extending from the positive terminal 22 of the battery to the audible alarm 25, with the bracket 24 serving as the negative ground. The audible alarm 25 may be a buzzer, bell, solid state device, or the like. With the battery used as the power source, the connection between the housing portions 11 and 12 is preferably releasable so as to provide access to the interior of the housing for changing batteries. Such a releasable connection might be a standard snap fit between the housing portions.

Figure 3:
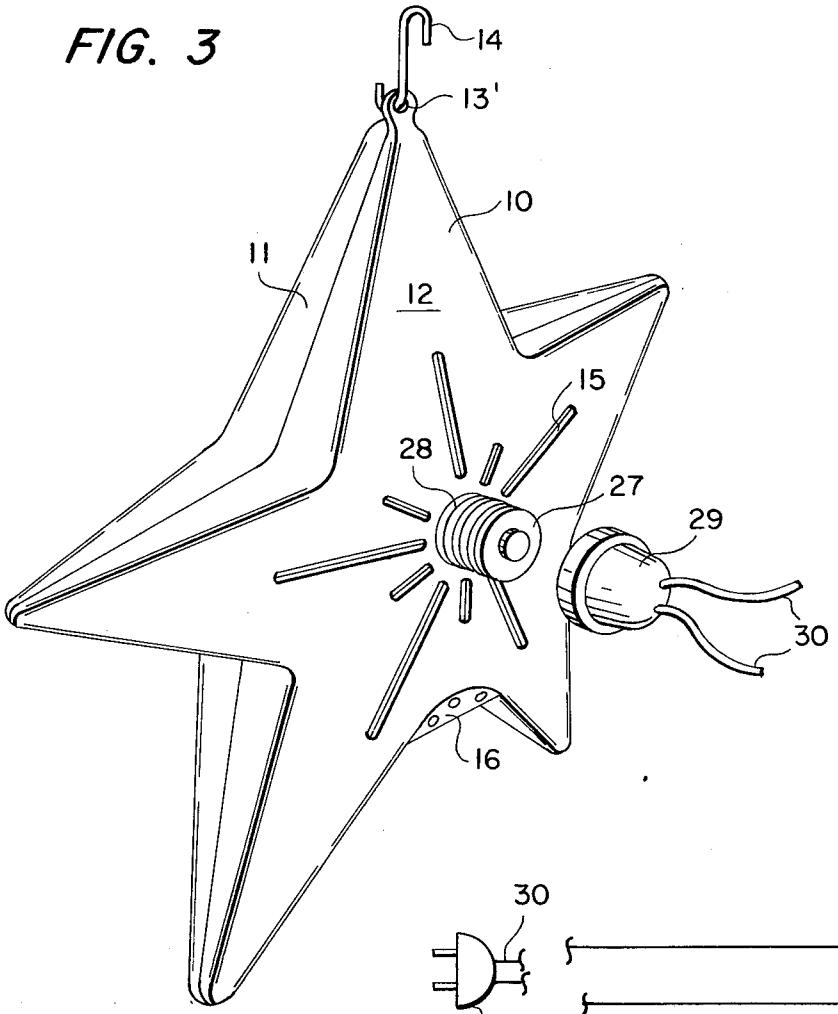
FIG. 3 is a rear perspective view of a second embodiment of the present invention.

In FIG. 3, there is shown a second embodiment of the present invention wherein like numerals are provided for like parts, and wherein elements are identical with those previously described except insofar as indicated below to be different, so that a further description of the common elements will not be provided.

In FIG. 3, only the front housing portion 11 is provided with an opening 13' for the reception of the hook 14, and the hook mountings shown in FIGS. 1 and 3 may be interchanged. An inside view of the rear housing portion 12 would be identical to that shown in FIG. 2 except that the battery 23 and its mounting 22, 21 would not be present, and in its place as a power source, the embodiment of FIG. 3 is provided with a standard size threaded electrical connection 27 that extends through a correspondingly sized hole 28 in the housing portion 12 so that it may be threaded into a standard Christmas tree lamp socket 29 for receiving power from a string of Christmas tree or Christmas decoration lights. In a conventional manner, the lamp socket 29 is provided with electrical power wires 30.

Figure 4:
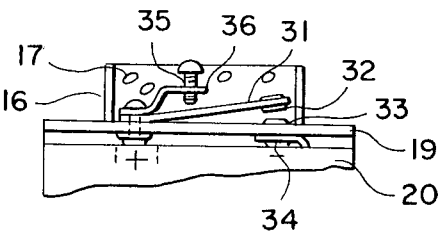
FIG. 4 is a partial cross-sectional view showing the sensing element for both embodiments.

As shown in FIG. 4, the detector 16 is provided with an electrical terminal that extends through the insulated board leg 19 to a bimetalic temperature responsive switch arm 31 that has at its outer free end a switch contact 32. The moveable switch contact 32 is aligned with a stationary switch contact 33 that has an electrical terminal portion 34 passing through the insulated board 19. As shown, the moveable contact may provide the positive terminal while the stationary contact may provide the negative terminal.

When it is heated, the bimetalic arm 31 will bend so as to move the contact 32 towards the contact 33, and at a fixed temperature, the contact 31 will engage the contact 32. At a higher fixed temperature, the solder of the contacts will melt, so that when the environment cools below the melting point of the solder, the solder will solidify to hold the contacts closed even after the temperature drops below the temperature at which the bimetalic arm 31 will be urging the contacts away from each other. Thus, the contacts will be locked in their actuated position. The temperature at which the bimetalic arm will engage the contacts 32 and 33 may be fixed or adjusted by the screw 35 that is threaded through a bracket 36 mounted on the terminal 30. To lower the contact engagement temperature, the screw 35 is adjusted inwardly to contact the arm 31 and move it towards the stationary contact 33. The fixed temperature at which the solder will melt upon a temperature rise and solidify upon a temperature drop may be easily determined by controlling the alloy mixture of the solder, in the known manner of providing solder melting temperatures. For example, the bimetalic arm 31 may be selected and the screw 35 adjusted so as to provide engagement of the contacts 32 and 33 within a temperature range of 130°–150° F, and the alloy of the solder may be selected so as to provide the melting temperature of the solder at 180° F.

As mentioned previously, a Christmas tree fire will rapidly produce very intense heat. Since the detector is primarily constructed of metal, it can withstand such heat and is located in the lower outside portion of the alarm device so as to be closest to the source of heat. The fire resistant housing material will provide some heat shielding for the interior of the housing. The space around the electrical components within the interior of the housing 11, 12 will provide further insulation for such electrical components. Since the openings 15 will be extending horizontally that is, they are somewhat in a vertical plane, radiation will not easily enter such openings from a fire below, and convection currents will not pass through such openings readily. Due to the concavity of the housing portion 11, the fire resistant board 18 will be spaced from the openings 15 to provide for passage of the sound, while at the same time providing for thermal insulation. The mounting board 18, which is fire resistant, will provide thermal insulation with respect to both the portions 19 and 20, with portion 19 particularly providing for insulation in the critical lower portion and thermally separating the detector housing from the electrical components within the interior of the housing 11, 12. To provide for further thermal insulation, there is preferably provided radiation reflecting aluminum foil wrapped so as to encircle or enclose completely the electrical components mounted on the board 18 within the housing 11, 12, with such aluminum foil 40 being only partially shown in FIG. 2 where is has been broken away so as to show the remaining components. This aluminum foil will reduce the transmission of heat through convection by providing an air barrier, will reduce the transmission of heat through radiation by providing a highly reflective surface between the source of radiation, that is the fire, and the interior electrical components, and although it has a high value for thermal conduction, thermal conduction will not be the primary source of rapid heat buildup for the electrical components with respect to a fire having the characteristics of a Christmas tree fire. Instead of aluminum foil, other material with similar heat reflecting and insulating qualities may be used.

Such thermal protection is desirable with respect to preventing the destruction of transistors that may be used to produce a variable audible output, or other heat sensitive components.

It is desirable to provide the free space within the housing 11, 12, that is the space within the housing 11, 12 that is not occupied by solid components, at least greater than 30% so as to provide a resonance cavity for the audible alarm.

Figure 5:
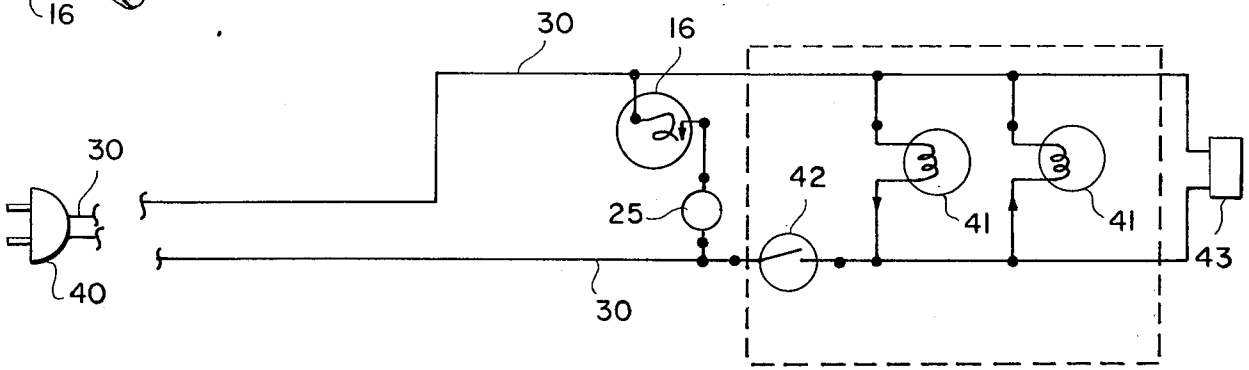
FIG. 5 is a schematic diagram of the embodiment of FIG. 3 in circuit with a plurality of Christmas tree lights.

In FIG. 5, there is shown an electrical schematic for the embodiment of FIG. 3. A conventional electrical prong plug 40 will provide electrical power to the lines 30 with conventional Christmas tree bulbs 41 connected in parallel between the lines 30. It is to be understood that each of the bulbs or lights 41 will comprise a conventional electrical socket 29 as shown in FIG. 3 and a conventional light bulb (not shown) screwed into such socket. There may be any desired number of such sockets 29 and conventional light bulbs. One of such sockets 29 may have such a conventional decorative bulb replaced by the embodiment of FIG. 3, which as shown in the schematic diagram includes the detector 16 and the alarm 25. In this manner, the device of the present invention may be sold as a separate unit for connection to any standard string of Christmas lights. If desired, the string of Christmas tree lights may be modified only with respect to including a manual switch 42 that may be used to disconnect the light bulbs 41 from the power supply while maintaining the fire alarm operative. As is conventional with such Christmas tree lights, a female plug 43 may be provided on the end of the string opposite from the male plug 40 for the connection of additional strings of lights. In this manner, all of the Christmas tree lights may be turned off by the switch 42 if the plug 40 is directly connected to an electrical wall outlet. Instead of employing a socket 29, threaded connection 27, the alarm may be directly wired into the circuit between lines 30 by the manufacturer of the light string.

Other types of sensors may be employed in place of the bimetalic switch, for example, a conventional photoelectric or ionization detector.

While preferred embodiments have been described in detail for purposes of illustration and the advantages of the details, variations have been set forth to show the broader aspects of the present invention, so that further embodiments, modifications, and variations are contemplated, all as determined by the spirit and scope of the following claims.

What is claimed is:

1. A Christmas tree ornament and fire alarm, comprising: a housing having an interior chamber; means for mounting the housing on the upper portion of a Christmas tree; detector means in communication with the environment exterior of the housing for providing a signal in response to a fire within the Christmas tree; means within the interior of said housing for providing an audible fire alarm in response to said signal; and a plurality of openings through said housing for passing the audible fire alarm signal from the interior of said housing to the exterior of said housing.

2. The Christmas tree ornament and fire alarm of claim 1, wherein said detector means is completely exterior of said housing, and further including a heat shield sealingly between said detector means and the interior chamber of said housing, and electrical conductor means passing through said heat shield for transfering said detector means signal from said detector means to said means for producing an audible signal.

3. The Christmas tree ornament and fire alarm of claim 2, wherein said detector means includes a tubular housing having one end opening downwardly, with respect to the normal mounting orientation as determined by said mounting means, its opposite end closed and sealed with respect to the interior chamber of said housing, and its tubular side walls perforated to provide for convection currents through said open lower end and the openings of said side walls.

4. The Christmas tree ornament and fire alarm of claim 2, wherein said audible alarm means is an electrical component; including an L-shaped circuit board having said audible alarm means mounted on the main leg and said detector means mounted on the minor leg; and a battery power source mounted on said board main leg, so that all of the electrical components including said detector means, power source and audible alarm means are mounted on said board independently of said housing.

5. The Christmas tree ornament and fire alarm of claim 4, wherein said detector means includes a tubular housing having one end opening downwardly, with respect to the normal mounting orientation as determined by said mounting means, its opposite end closed and sealed with respect to the interior chamber of said housing, and its tubular side walls perforated to provide for convection currents through said open lower end and the openings of said side walls.

6. The Christmas tree ornament and fire alarm of claim 5, wherein said tubular housing is rigidly secured to the minor leg of said mounting board and has its said opposite end closed and sealed by said minor leg.

7. The Christmas tree ornament and fire alarm of claim 1, wherein said detector means includes a thermostatic switch having a stationary contact and a moveable contact, bimetalic means for moving said moveable contact into engagement with such stationary contact at a fixed actuation temperature, and engagement means for maintaining said contacts in engagement independently of said bimetalic means.

8. The Christmas tree ornament and fire alarm of claim 7, wherein said engagement means includes solder on at least one of said contacts for engagement by the other of said contacts and being meltable at a melting temperature higher than said actuation temperature so as to melt after engagement and solidify upon subsequent cooling prior to cooling to said actuation temperature for preventing separation of said contacts at temperatures below said melting temperature.

9. The Christmas tree ornament and fire alarm of claim 1, including a threaded plug of a size and shape to be threaded into a conventional Christmas tree light bulb socket, and extending exteriorly of said housing; and electrical wire means for transmitting electricity from said plug to the interior chamber of said housing.

10. The Christmas tree ornament and fire alarm of claim 9, in combination with a conventional string of Christmas tree lights including an electrical outlet plug for insertion in a conventional electrical wall outlet, and electrical wires having a plurality of lamp sockets in electrical parallel circuit; said threaded plug being telescopically threadedly received with one of said lamp sockets and the remainder of said lamp sockets having lightbulbs therein; and a manual switch within said circuit for electrically disconnecting said remainder of said lamp sockets without disconnecting said one lamp socket from the electrical outlet plug.

11. The Christmas tree ornament and fire alarm of claim 1, wherein said means for producing an alarm is an electrical component; and including metalic foil within said housing and wrapped around the electrical components within said housing to function as radiation and convection shield means.

12. The Christmas tree ornament and fire alarm of claim 1, wherein said means for producing an alarm is an electrical component; and including sheet insulating material within said housing and wrapped around the electrical components within said housing to function as radiation and convection shield means.

13. The Christmas tree ornament and fire alarm of claim 1, wherein said housing is star-shaped.

14. The Christmas tree ornament and fire alarm of claim 2, wherein said audible alarm means is an electrical component completely within said housing; including a unitary circuit board having said audible alarm means mounted solely on one end and said detector means mounted solely on the other end, so that all of the electrical components including said detector means and audible alarm means are mounted on said unitary circuit board independently of said housing for interchangeable assembly in different shaped housings.

15. A fire alarm, comprising: a housing providing an interior chamber; detector means in communication with the environment exterior of the housing for providing a signal in response to a fire; electrical means completely within the interior of said housing for providing an audible fire alarm in response to said signal; a plurality of openings through said housing for passing the audible fire alarm signal from the interior of said housing to the exterior of said housing said detector means completely exterior of said housing; a heat shield sealingly between said detector means and the interior chamber of said housing; electrical conductor means passing through said heat shield for transfering said detector means signal from said detector means to said means for producing an audible signal; a unitary circuit board having said audible alarm means mounted solely on one end and said detector means mounted solely on the other end, so that all of the electrical components including said detector means and audible alarm means are mounted on said unitary circuit board independently of said housing for interchangeable assembly in different shaped housings.

* * * * *